US010334955B2

(12) United States Patent
Thompson et al.

(10) Patent No.: US 10,334,955 B2
(45) Date of Patent: Jul. 2, 2019

(54) MODULAR MATTRESS FOUNDATION HAVING GENERALLY LADDER-SHAPED SECTIONS

(71) Applicant: L&P Property Management Company, South Gate, CA (US)

(72) Inventors: Seth A. Thompson, Carthage, MO (US); Kyle S. Tucker, Carl Junction, MO (US)

(73) Assignee: L&P Property Management Company, South Gate, CA (US)

( * ) Notice: Subject to any disclaimer, the term of this patent is extended or adjusted under 35 U.S.C. 154(b) by 470 days.

(21) Appl. No.: 15/357,397

(22) Filed: Nov. 21, 2016

(65) Prior Publication Data

US 2018/0140103 A1 May 24, 2018

(51) Int. Cl.

| | |
|---|---|
| ***A47C 19/02*** | (2006.01) |
| ***A47C 19/00*** | (2006.01) |
| ***A47C 17/86*** | (2006.01) |

(52) U.S. Cl.

CPC ..... *A47C 19/025* (2013.01); *A47C 17/86* (2013.01); *A47C 19/005* (2013.01)

(58) Field of Classification Search

CPC ..... A47C 19/025; A47C 19/027; A47C 19/00; A47C 19/005; A47C 19/02; A47C 19/021; A47C 23/005; A47C 23/061; A47C 23/062; A47C 17/86; A47C 17/645

USPC ..... 5/201, 282.1, 285, 286, 292, 304, 305, 5/310; 108/56.1, 56.3

See application file for complete search history.

(56) References Cited

U.S. PATENT DOCUMENTS

| | | | | |
|---|---|---|---|---|
| 3,256,839 | A * | 6/1966 | Peterson | B65D 19/0073 108/56.1 |
| 5,458,068 | A * | 10/1995 | Kilpatrick | B65D 19/0012 108/51.3 |
| 5,701,653 | A * | 12/1997 | Rupe | A47C 19/021 29/432 |
| 6,865,758 | B2 * | 3/2005 | Harrow | A47C 19/005 403/382 |
| 7,937,788 | B2 | 5/2011 | Felix | |
| 9,226,590 | B1 * | 1/2016 | Hull | F16B 12/56 |
| 9,924,803 | B2 * | 3/2018 | Rodgers | A47C 19/005 |
| 2009/0000030 | A1 * | 1/2009 | Hicks | A47C 19/005 5/400 |
| 2010/0154118 | A1 * | 6/2010 | Pearce | A47C 19/005 5/201 |
| 2010/0170190 | A1 * | 7/2010 | Schulz, Jr. | A47C 19/005 52/745.19 |
| 2010/0229303 | A1 * | 9/2010 | Goldsmith | A47C 19/005 5/285 |

* cited by examiner

*Primary Examiner* — Eric J Kurilla
*Assistant Examiner* — Amanda L Bailey
(74) *Attorney, Agent, or Firm* — Wood, Herron & Evans, LLP

(57) ABSTRACT

A modular mattress foundation comprises multiple sections which may be secured together quickly and easily so that the mattress foundation may be easily broken down into pieces for storage or transportation. Each section has a ladder-like shape. In one embodiment, each side section is generally L-shaped having curved members. A middle ladder extends parallel the sides and may be secured to the outer frame in any known manner. Deck members extend transversely and pass through the middle ladder.

22 Claims, 18 Drawing Sheets

MODULAR MATTRESS FOUNDATION HAVING GENERALLY LADDER-SHAPED SECTIONS

FIELD OF THE INVENTION

This invention relates generally to bedding foundations and, more particularly, to a modular mattress foundation which may be easily assembled for use and disassembled for storage and shipment.

BACKGROUND OF THE INVENTION

Conventional mattress foundations, such as box springs, typically include plurality of modular springs, a wooden base and an upper wire deck, including a generally rectangular border wire. The modular springs are attached to the upper wire deck to form a nestable, stackable upper wire unit. A plurality of such upper wire units are nestably stacked and shipped from a bedding components manufacturer to a manufacturer of finished bedding products. Additionally, a plurality of wooden bases are stacked and shipped from the bedding components manufacturer to the manufacturer of finished bedding products. Once the components arrive at the finished bedding manufacturer's facility, the finished bedding manufacturer attaches the lower ends of the modular springs, which extend downwardly from the upper deck assembly, to a base. Padding and a cover are applied by the foundation manufacturer as desired. Such conventional bedding foundation components are large and cumbersome to handle in storage, transportation or shipment which, of course, increases the ultimate cost.

In recent years bedding products which may be shipped in a box directed to a customer have become increasingly desirable with the rise in e-commerce. Due to their construction, mattresses may be compressed and rolled inside a box of a size which is small enough that the box is not subject to additional shipping charges. Typically, foundations are rigid and may not be compressed and/or roll packed. Therefore, foundations have not fit into a parcel carrier friendly box exempt from the parcel carrier's additional charges for oversize packaging.

Unlike a mattress, a foundation is typically rigid and may not be compressed. Consequently, foundations have been subject to an oversize shipping charge. Therefore there is a need for a modular bedding foundation for the e-commerce market which may be shipped in a box which is small enough to avoid a parcel carrier's oversize charges, thereby resulting in savings to a customer.

There is further a need for a modular foundation which is easy to assemble and disassemble. There is further a need for an affordable bedding foundation which may be shipped at a reasonable price directly to a customer via e-commerce.

SUMMARY OF THE INVENTION

The mattress foundation of the present invention comprises eight ladder-shaped sections which may be secured together with a limited number of connections such as fasteners. The sections or modules of the foundation may be shipped in a box to a customer via the U.S. Postal Service or private shipping company or parcel carrier including UPS® or FedEx®. The foundation may fit inside a box which is not subject to additional fees for oversized parcels. One example of such a box has the following outside dimensions: 7.25 inches by 7.25 inches by 61 inches.

However, to accommodate different foundation sizes, these box outer dimensions are not intended to be limiting.

A customer may quickly and easily assemble the foundation with a limited number of connections which in some applications may be fasteners. If a user wishes to change the location of the foundation and/or ship the foundation to another location, the sections or modules of the foundation may be quickly and easily separated from each other or disassembled. In one embodiment, the foundation is maintained in its erected position or condition by six connections. The connections may be nuts and bolts or any other fasteners requiring a tool to operate. Alternatively, the connections may be such that they do not require tools.

In one embodiment, the modular foundation has two sides, each side comprising a swaged side section and a standard side section joined together without fasteners. Each of the standard side sections comprises upper and lower generally L-shaped upper tubes and a plurality of spacers extending between the generally L-shaped upper and lower tubes. Each of the generally L-shaped upper tubes of each of the standard side sections has open ends.

Each of the swaged side sections comprises generally L-shaped upper and lower tubes and a plurality of spacers extending between the generally L-shaped upper and lower tubes. One end of one of the generally L-shaped upper and lower tubes of the swaged side section is swaged and adapted to be retained inside one of the open ends of one of the generally L-shaped tubes of one of the standard side sections.

The modular foundation further comprises a head end section and a foot end section. Each of the end sections comprises a straight upper tube, a straight lower tube and a plurality of spacers extending therebetween. Each end of each of the straight upper and lower tubes is swaged, the swaged ends of the straight upper and lower tubes fit inside the open ends of the generally L-shaped tubes of one of the side sections upon assembly.

The modular foundation further comprises a middle ladder comprising two middle sections joined together. Each of the middle sections comprises a straight upper tube, a straight lower tube and a plurality of spacers extending therebetween. At least one of the straight upper and lower tubes of each middle section has openings extending through the tube.

The modular foundation further comprises decking members extending through the openings in the middle sections. Each of the decking tubes has end portions located inside the upper generally L-shaped tubes of the side sections. Connectors, including but not limited to fasteners, secure the middle sections to the head and foot end sections.

Each of the eight sections of the modular foundation is generally ladder-shaped, two of the four side sections being identical and the other two being identical to each other. Each of the middle sections is identical, but oriented differently in an assembled foundation. Each of the end sections is identical. Thus, the foundation uses only four different types of modules or sections. This reduces manufacturing costs and enables the retail price to be reduced.

In one embodiment, the modular bedding foundation or body support comprises four generally L-shaped side sections, each of the generally L-shaped side sections having a long portion and a short portion joined by a corner portion. The modular foundation further comprises two end sections. Each of the end sections comprises a straight upper tube, a straight lower tube and a plurality of spacers extending between the straight upper and lower tubes of the end section. Each end of each of the straight upper and lower tubes of each end section is swaged. The swaged ends of each of the straight upper and lower tubes of the end sections are retained inside open ends of tubes of the short portions of the generally L-shaped side sections to join the end and generally L-shaped side sections without fasteners.

The modular foundation further comprises a middle ladder comprising two middle sections joined together without fasteners. Each of the middle sections comprises a straight upper tube, a straight lower tube and a plurality of spacers extending between the straight upper and lower tubes.

The modular foundation further comprises decking members extending through openings of the middle sections. Each of the decking members has end portions located inside the generally L-shaped side sections. Two of the decking members are secured to the side sections of the foundation with connectors, including but not limited to fasteners, for stability. However, any number of decking members may be secured to the side sections of the foundation with any known connectors. Connectors may also secure the middle sections of the middle ladder to the head and foot end sections for stability.

In one embodiment, the modular bedding foundation comprises an outer frame comprising four side sections, a generally planar head end section and a generally planar foot end section. Each of the sections of the outer frame is joined to adjacent sections using swaged ends fitted inside hollow ends without fasteners.

Each of the side sections comprises upper and lower generally L-shaped upper tubes and spacers extending between the generally L-shaped upper and lower tubes. Each of the generally L-shaped upper and lower tubes of the side section has a long leg portion, a short leg portion and a rounded corner. Each of the short leg portions terminates in a hollow end. Swaged ends of the head and foot end sections are retained inside hollow ends of the side sections.

The modular foundation further comprises a middle ladder secured to the head and foot end sections of the outer frame. The middle ladder comprising multiple middle sections joined together without fasteners, each of the middle sections comprising straight upper and lower tubes and a plurality of spacers.

The modular foundation further comprises decking members extending through openings in the middle sections. Each of the decking members has end portions located inside the upper generally L-shaped tubes of the side sections.

DETAILED DESCRIPTION OF THE DRAWINGS

Figure 1:
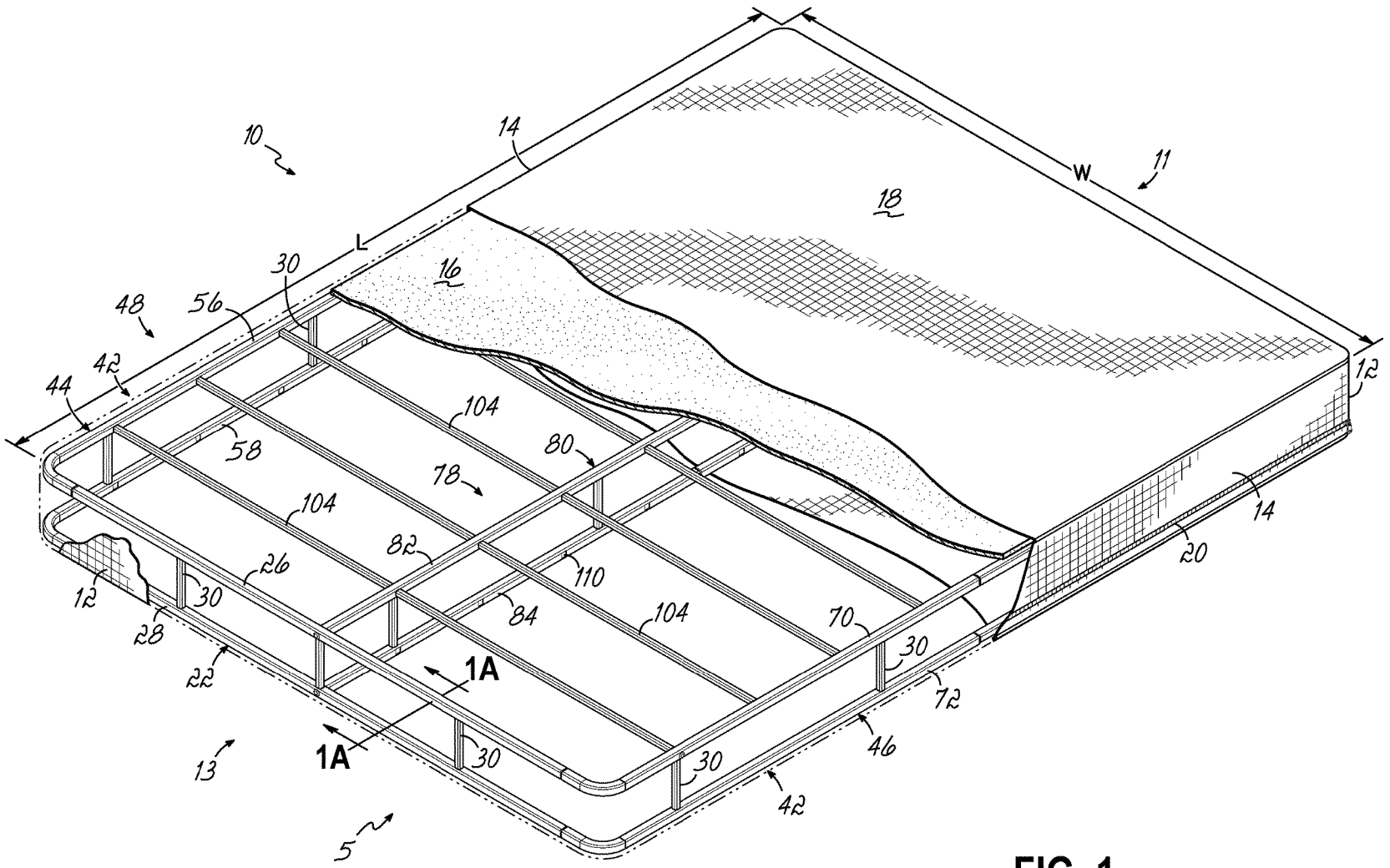
FIG. 1 is a perspective view of one embodiment of the modular bedding foundation in an assembled condition with a removable cover.

Referring to the drawings, and particularly to FIG. 1, there is illustrated a modular mattress foundation 10. In an assembled condition, the mattress foundation 10 has a pair of end surfaces 12 defining a length or longitudinal dimension L of the assembled foundation 10 and a pair of opposed side surfaces 14 defining a width W of the assembled foundation 10. As best shown in FIG. 1, the assembled foundation 10 has a head end 11 and a foot end 13.

Figure 19:
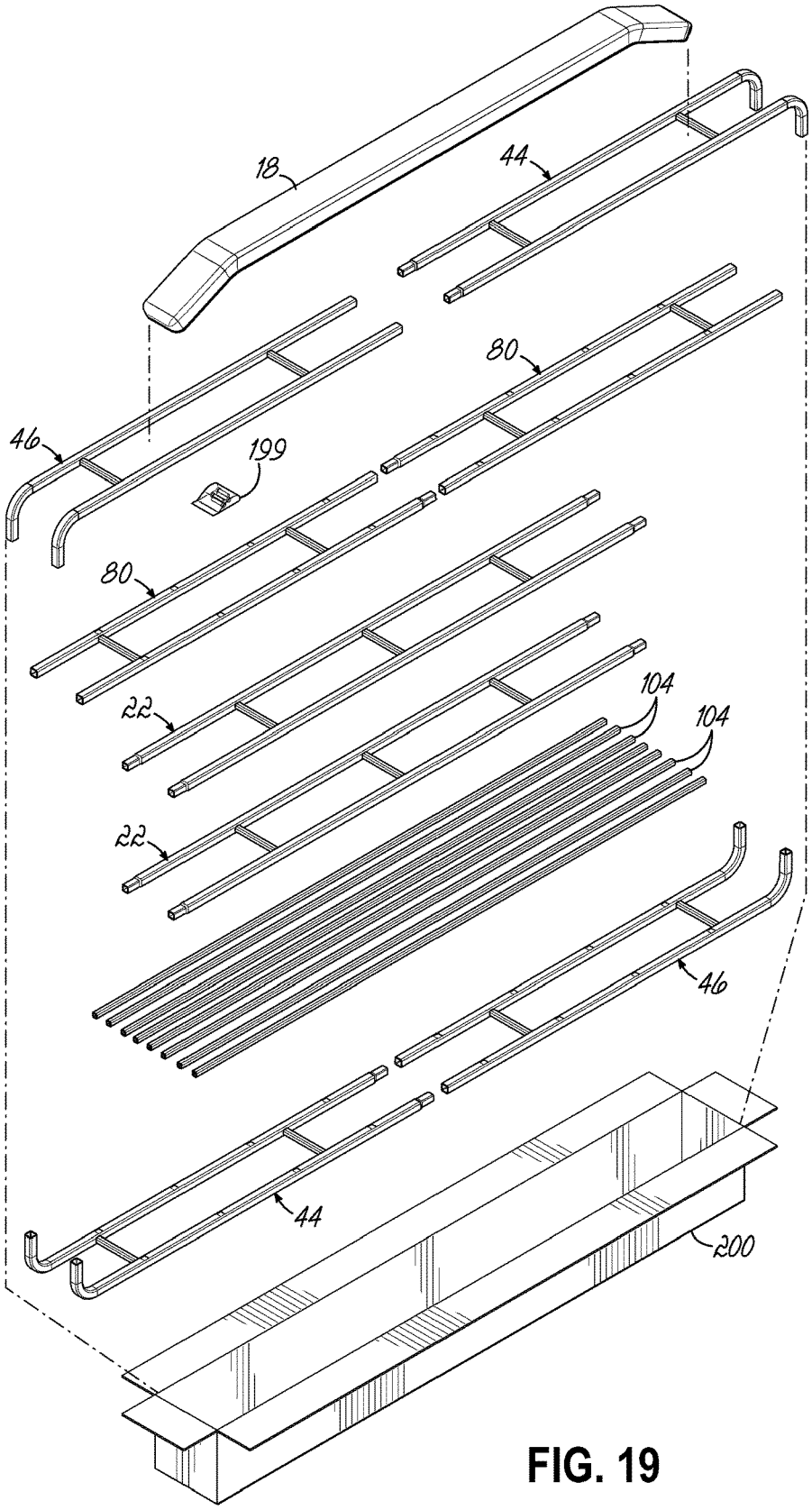
FIG. 19 is a perspective view of the foundation of FIG. 1 showing the components of the foundation before being boxed.
Figure 20:
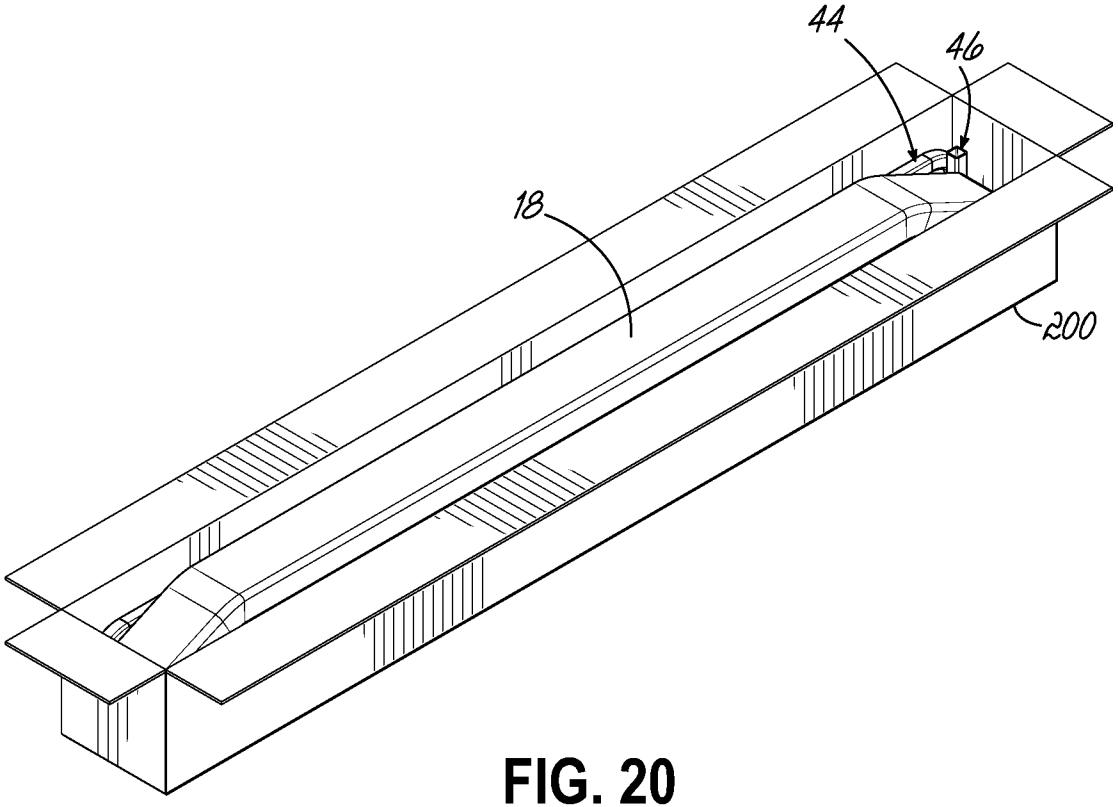
FIG. 20 is perspective view of the foundation shown in FIG. 19 showing all the components of the foundation inside the box.

The assembled foundation frame 5 comprises eight modules and a plurality of deck members 104 joined together. Although the modules are illustrated being joined with fasteners, they may be joined in any known manner which may or may not require the use of tools. The ladder-shaped modules and a package 199 of connectors such as fasteners may be shipped from a manufacturer to a customer directly inside a box 200, as shown in FIGS. 19 and 20.

The assembled modular foundation 10 is shown in FIG. 1 with padding 16 and a surrounding cover 18. If desired, the padding may be omitted or comprise more than one layer. The padding may be placed on at least one surface of the assembled bedding foundation 10 before the surrounding cover 18 is attached. The cover 18 is illustrated having a zipper 20 therein. However, any removable cover may be used. If a cover has a zipper, the zipper may be at any desired location; the drawings are not intended to limit the cover in any manner.

Figure 2:
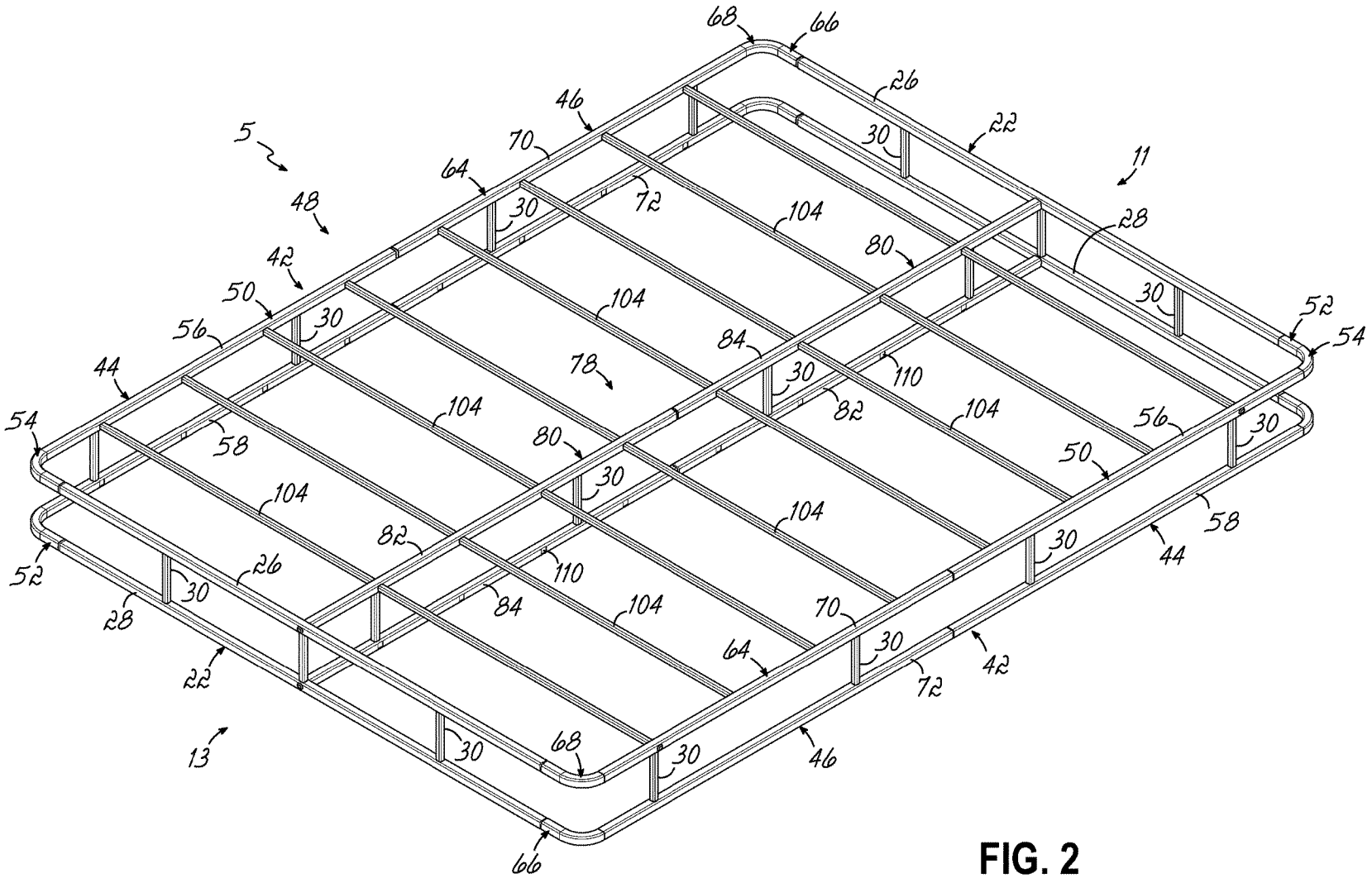
FIG. 2 is a perspective view of the modular bedding foundation of FIG. 1 without any cover.

FIG. 2 shows the foundation frame 5 in an assembled condition prior to being padded and covered. The foundation frame 5 comprises an outer frame 48 as described below, a middle ladder 78 and a plurality of decking members 104.

Figure 3:
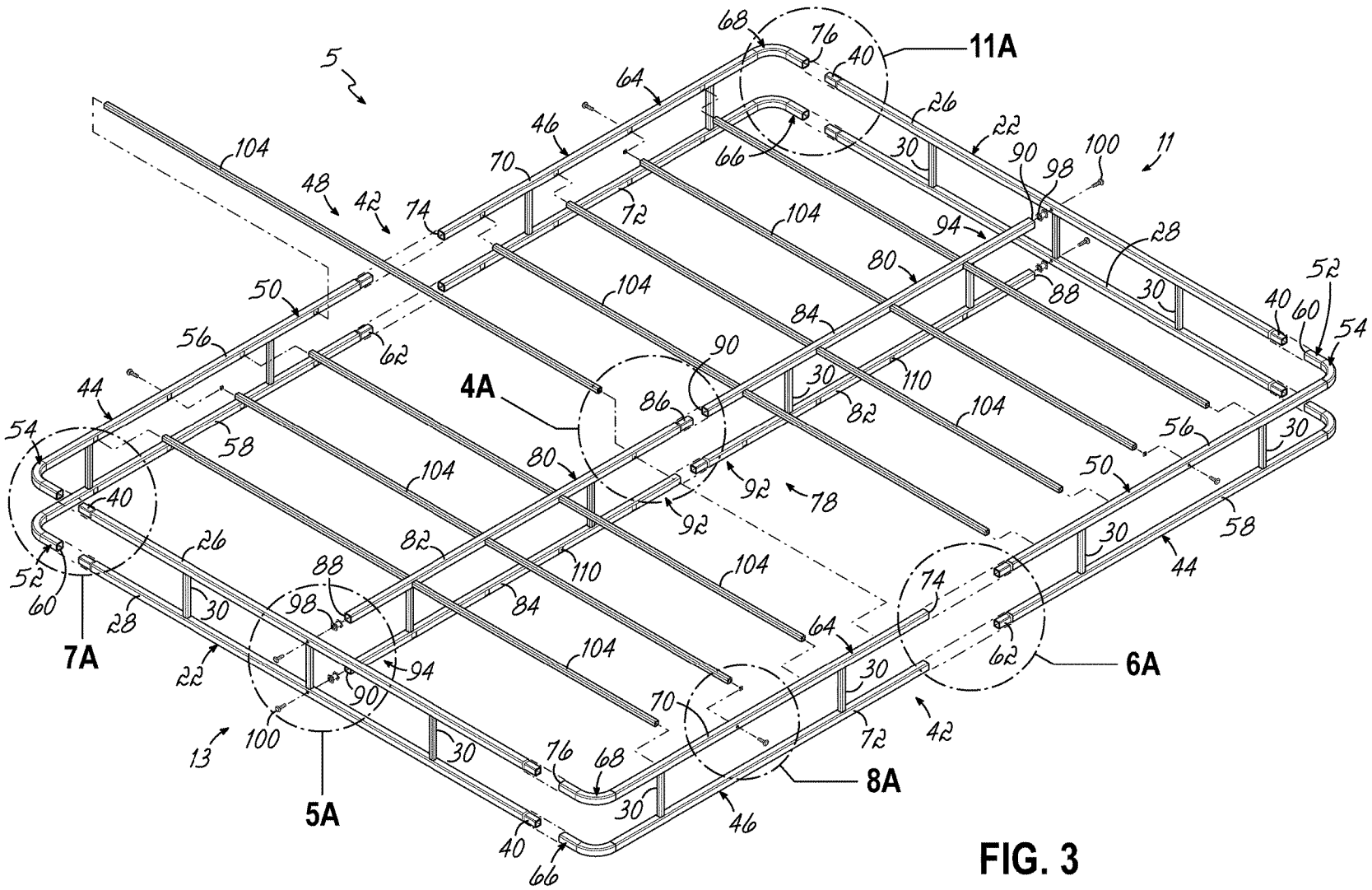
FIG. 3 is a perspective view of the modular bedding foundation of FIG. 2 in a partially disassembled condition.

FIG. 3 illustrates the modules and decking members of one embodiment of foundation prior to assembly. The modular foundation frame 5 comprises two identical end sections 22. One of the end sections 22 is located at the foot end 13 of the foundation 10, so it will be referred to as a foot end section. The other end section 22 is located at the head end 11 of the foundation 10, so it will be referred to as a head end section. Each end section 22 comprises a straight upper tube 26, a straight lower tube 28 and a plurality of spacers 30 extending between the straight upper and lower tubes 26, 28. Each of the spacers 30 is preferably welded, but may be secured in any known manner, to the straight upper and lower tubes 26, 28 of each end section 22. Although each end section 22 is illustrated having three spacers 30, any number of spacers may be used.

Figure 1A:
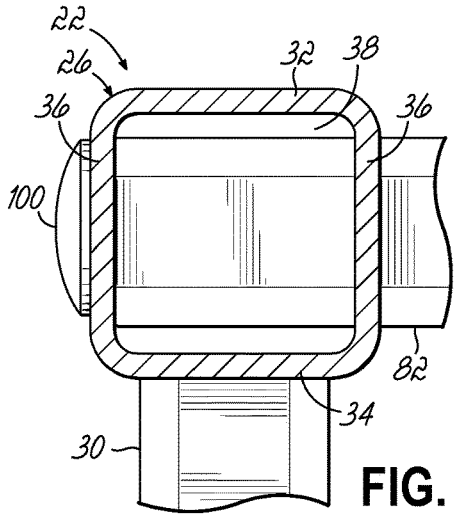
FIG. 1A is a cross-sectional view taken along the line 1A-1A of FIG. 1.

As shown in FIG. 1A, each of the upper and lower tubes 26, 28 of end section 22 is generally rectangular in cross section, having an upper wall 32, a lower wall 34 and two side walls 36 defining a hollow interior 38. However, the term "tube" in this document is not limited to pieces having rectangular cross-sections. The pieces may have circular or other shaped cross-sections.

Figure 7A:
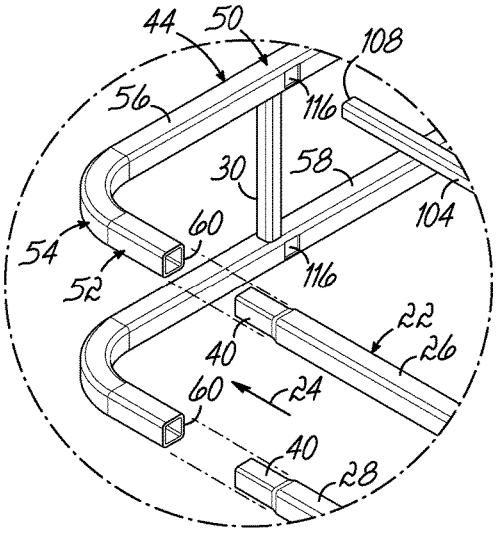
FIG. 7A is an enlarged perspective view of the encircled area 7A of FIG. 3.
Figure 7B:
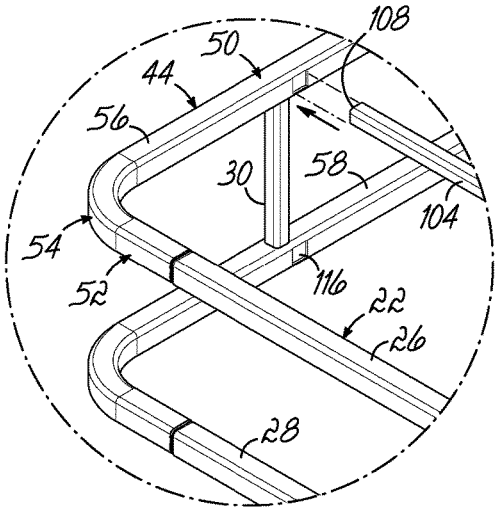
FIG. 7B is an enlarged perspective view of the encircled area 7A showing the end section and side section of FIG. 7A being joined.
Figure 7C:
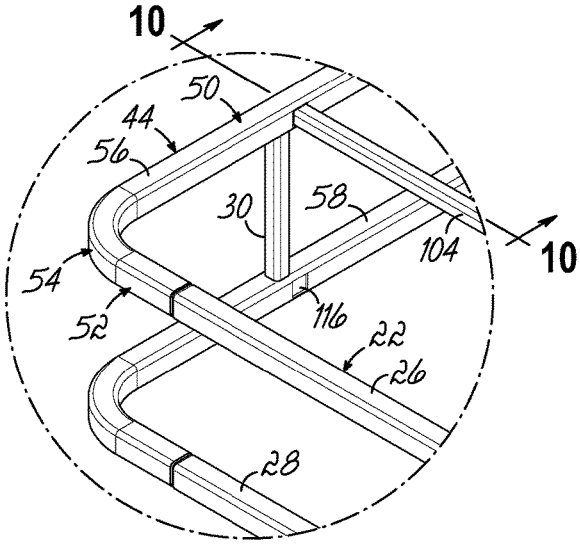
FIG. 7C is an enlarged perspective view of the encircled area 7B fully assembled.

As best shown in FIG. 7A, each of the upper and lower tubes 26, 28 of each of the end sections 22 has a swaged end 40 at each end of the tube. Each swaged end 40 is defined as having the same general cross-sectional shape as the remainder of the tube, but being smaller in size in order to fit inside a hollow end of another tube as described below and shown in the drawings. Each swaged end 40 is preferably integral with the remainder of the tube but may be a separate piece attached to a hollow end of the tube.

The assembled modular bedding foundation frame 5 further comprises two sides 42. As best shown in FIG. 3, each side 42 comprises a swaged side section 44 and a standard side section 46 joined together. Together, the two sides 42 and two end sections 22 make up an outer frame 48. More particularly, the outer frame 48 comprises end sections 22 at the head and foot ends of the outer frame 48, two swaged side sections 44 located at opposed corners of the outer frame 48 and two standard side sections 46 located at opposed corners of the outer frame 48. The six sections of the outer frame 48 are joined together without the use of fasteners, the swaged ends of some of the outer frame sections fitting inside hollow ends of other of the outer frame sections.

As best shown in FIG. 3, each of the two swaged side sections 44 of the outer frame 48 has a long portion 50, a short portion 52 and a corner portion 54 therebetween and therefore is generally L-shaped. Each swaged side section 44 comprises a generally L-shaped upper tube 56, a generally L-shaped lower tube 58 and a plurality of spacers 30 extending between the generally L-shaped upper and lower tubes 56, 58. Although each swaged side section 44 is illustrated having two spacers 30, any number of spacers may be used. As best shown in FIG. 7A, at the end of the short portion 52 of each swaged side section 44, each of the generally L-shaped upper and lower tubes 56, 58, respectively, has a hollow end 60 at the outer end of the tube.

As best shown in FIG. 7A, each hollow end 60 is adapted to receive a swaged end 40 of one of the straight upper and lower tubes 26, 28, respectively, of foot end section 22. As best shown in FIG. 3 at the head end of the foundation, the hollow ends 60 of the generally L-shaped upper and lower tubes 56, 58 of the other swaged side section 44 are adapted to receive swaged ends 40 of the straight upper and lower tubes 26, 28, respectively, of head end section 22 (shown to the right of the head end section 22 in FIG. 3). These connections between the two swaged side sections 44 and the end sections 22 do not require any fasteners and may be performed quickly and easily by a person assembling the foundation without any tools by moving the end sections 22 in the direction of arrow 24 shown in FIG. 7A.

Figure 6A:
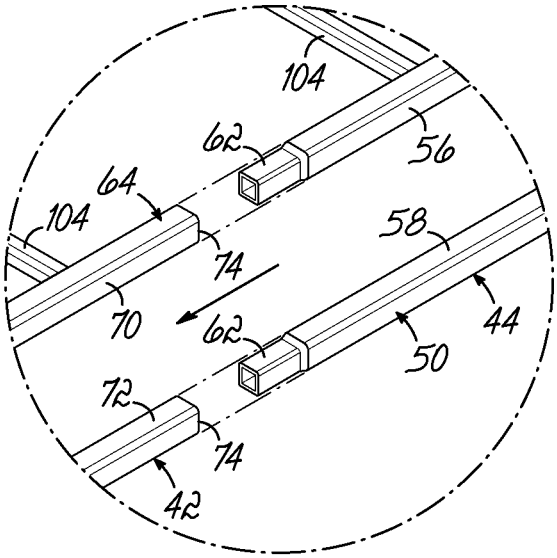
FIG. 6A is an enlarged perspective view of the encircled area 6A of FIG. 3.
Figure 6B:
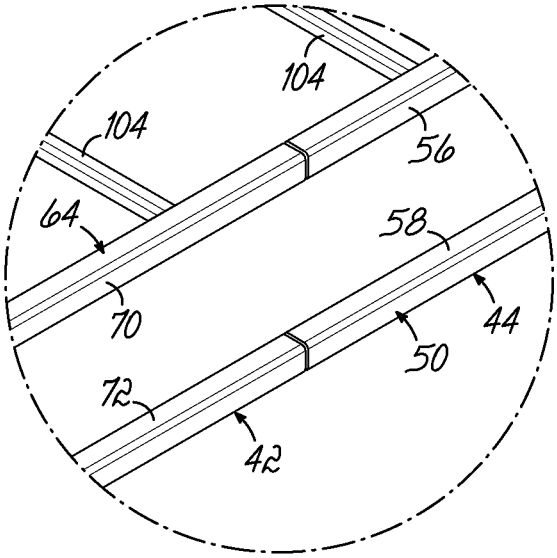
FIG. 6B is an enlarged perspective view of the encircled area 6A adjacent side sections being joined together.

As best shown in FIGS. 3 and 6A, at the end of the long portion 50 of each swaged side section 44, each of the generally L-shaped upper and lower tubes 56, 58, respectively, has a swaged end 62 at the outer end of the tube.

As best shown in FIG. 2, each of the two standard side sections 46 has a long portion 64, a short portion 66 and a corner portion 68 therebetween and, therefore, are generally L-shaped. Each standard side section 46 comprises a generally L-shaped upper tube 70, a generally L-shaped lower tube 72 and a plurality of spacers 30 extending between the generally L-shaped upper and lower tubes 70, 72. Each of the spacers 30 is preferably welded, but may be secured in any known manner, to the generally L-shaped upper and lower tubes 70, 72. Although each standard side section 46 is illustrated having two spacers 30, any number of spacers may be used.

Figure 11A:
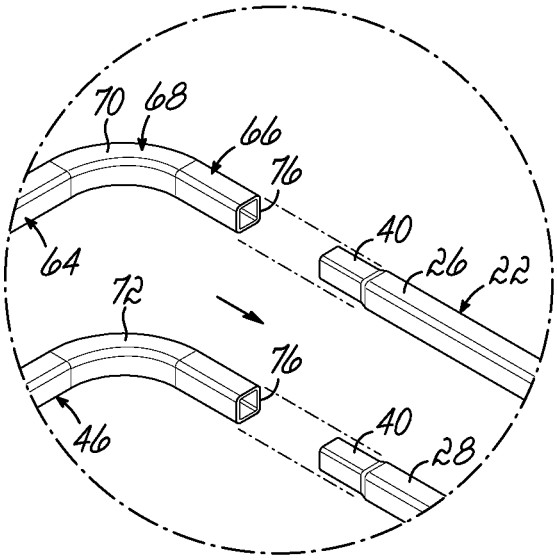
FIG. 11A is an enlarged perspective view of the encircled area 11A of FIG. 3.
Figure 11B:
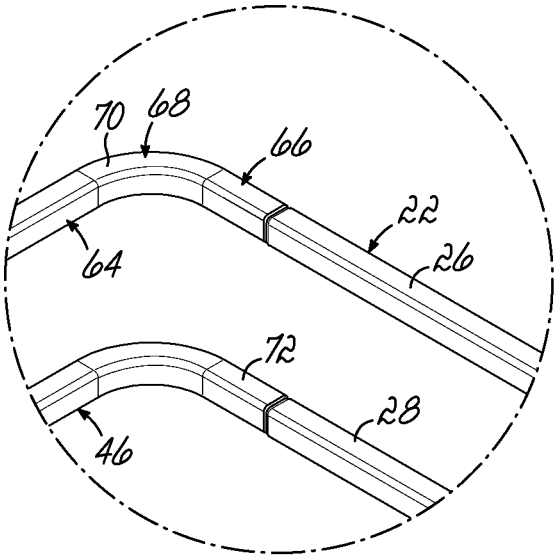
FIG. 11B is an enlarged perspective view of the encircled area 11A showing the end section and side section of FIG. 11A being joined.

As best shown in FIGS. 3 and 6A, each of the generally L-shaped upper and lower tubes 70, 72 of each standard side section 46 has a uniform cross-sectional configuration along its length including hollow ends 74, 76. Each of the generally L-shaped upper and lower tubes 70, 72 of each standard side section 46 has no swaged ends. As shown in FIG. 6A, a hollow end 74 of each of the generally L-shaped upper and lower tubes 70, 72 is located at the outer end of the long portion 50 of each standard side section 46. As best shown in FIG. 11A, the opposed hollow end 76 of each of the generally L-shaped upper and lower tubes 70, 72 is located at the outer end of the short portion 66 of each standard side section 46.

As best shown in FIG. 11A, the hollow ends 76 of the generally L-shaped upper and lower tubes 70, 72 at the end of the short portion 68 of one of the two standard side sections 46 are adapted to receive the swaged ends 40 of the straight upper and lower tubes 26, 28, respectively, of head end section 22. Similarly, as best shown in FIG. 3, at the foot end of the foundation, the hollow ends 76 of the generally L-shaped upper and lower tubes 56, 58 at the end of the short portion 68 of the other standard side section 46 are adapted to receive swaged ends 40 of the straight upper and lower tubes 26, 28, respectively, of foot end section 22 (shown to the right of the foot end section 22 in FIG. 3). These connections between the two standard side sections 46 and the end sections 22 do not require any fasteners and may be performed quickly and easily by a person assembling the foundation without any tools.

The modular bedding foundation frame 5 further comprises a middle ladder 78 comprising two identical middle sections 80 joined together in a swaged manner as described herein without fasteners. Each of the middle sections 80 comprises a straight swaged tube 82, a straight standard tube 84 and a plurality of spacers 30 extending between the straight swaged and standard tubes 82, 84, respectively. Each of the spacers 30 is preferably welded, but may be secured in any known manner, to the straight swaged and standard tubes 82, 84. As best shown in FIG. 3, each of the middle sections 80 is ladder-shaped with the straight swaged and standard tubes 82, 84, respectively, being parallel and the spacers 30 being perpendicular to the swaged and standard tubes 82, 84. Although each middle section 80 is illustrated having two spacers 30, any number of spacers may be used.

Figure 4A:
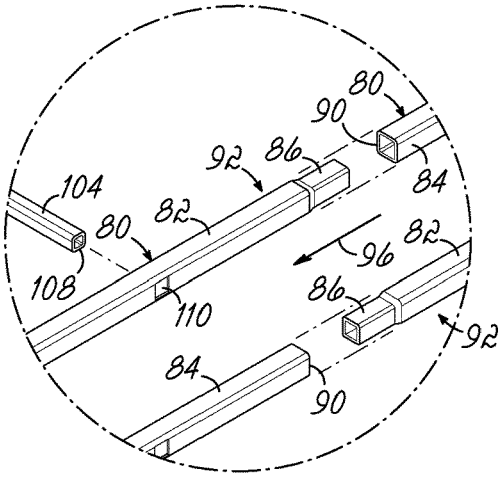
FIG. 4A is an enlarged perspective view of the encircled area 4A of FIG. 3.
Figure 5A:
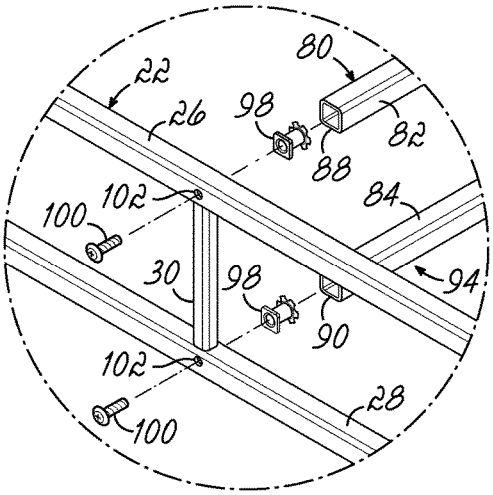
FIG. 5A is an enlarged perspective view of the encircled area 5A of FIG. 3 showing the outer side of one of the middle sections prior to the middle section being secured to one of the sides.

As best shown in FIGS. 4A and 5A, the straight swaged tube 82 of each middle section 80 has a swaged end 86 and an unswaged end 88. The standard tube 84 of each middle section 80 has opposed unswaged ends 90. Therefore, each middle section 80 has a swaged end portion 92 and an unswaged end portion 94.

In order to assemble the middle ladder 78, one of the two middle sections 80 is flipped and rotated relative to the other middle section 80 of the middle ladder 78 so that the swaged end portions 92 of the two middle sections are next to each other and oriented as shown in FIG. 4A before being connected to each other. As shown in FIG. 4A, after orienting the middle sections as shown, by moving the middle sections 80 together in the direction of arrow 96, the swaged end 86 of the straight swaged tube 82 of each of the middle sections 80 is received inside the unswaged end 90 of the straight standard tube 84 of other middle section 80. As shown in FIG. 3, the unswaged end portions 94 of the middle sections 80 face outwardly and are joined to the outer frame with fasteners in a manner described below. By using only the swaged end portions 92 of the middle sections 80, the two middle sections 80 are joined together without any need for any fasteners, thereby reducing cost and time of assembly/disassembly.

Figure 5B:
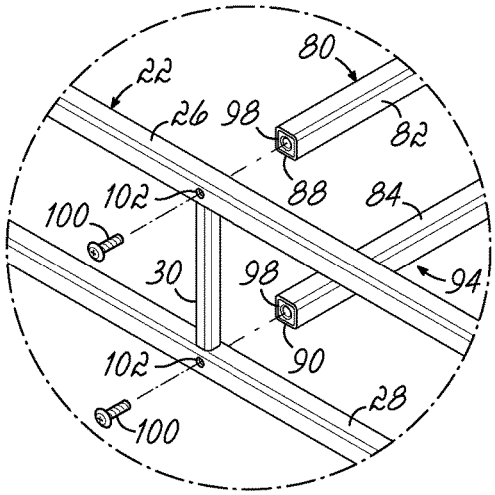
FIG. 5B is an enlarged perspective view of the encircled area 5A showing inserts inside the upper and lower tubes of one of the middle sections prior to the middle section being secured to one of the sides.
Figure 5C:
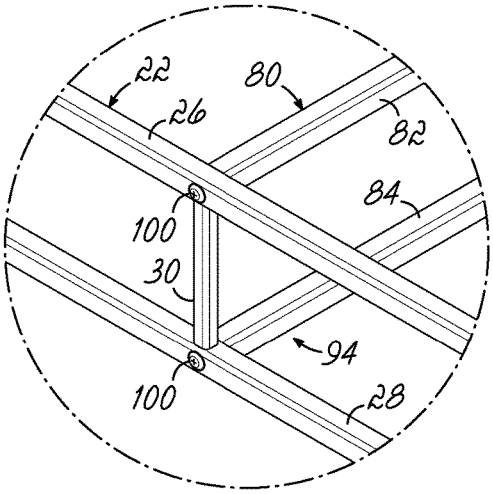
FIG. 5C is an enlarged perspective view of the encircled area 5B showing the bolts secured to the inserts inside the upper and lower tubes of one of the middle sections.

As best shown in FIGS. 5A and 5B, an insert 98 is placed inside the hollow interior of the unswaged end 88 of the straight swaged tube 82 of each middle section 80 (only one being shown) at the unswaged end portion 94 of the middle section 80. Similarly, an insert 98 is placed inside the hollow interior of the unswaged end 90 of the straight unswaged tube 84 of each middle section 80 (only one being shown) at the unswaged end portion 94 of the middle section 80. Each insert 98 shown in FIGS. 5A-5C is adapted to receive a screw 100 extending through openings 102 in the upper and lower tubes 26, 28 of foot end section 22. As shown in FIG. 3, inserts 98 and screws 100 similarly secure the other middle section 80 to the head end section 22. The screws 100 and inserts 98 function to secure the middle ladder 78 to the outer frame 48 and, more particularly, secure the middle ladder 78 to the end sections 22, thereby adding stability and rigidity to the foundation 10.

The bedding foundation frame 5 further comprises a plurality of identical decking members 104, each having a hollow interior 106 and opposed ends 108. See FIGS. 9 and 10. Each of the decking members 104 is linear or straight and extends between one of the swaged side sections 44 and one of the standard side sections 46. More particularly, each of the decking members 104 extends between one of the upper tubes 56 of one of the swaged side sections 44 and one of the upper tubes 70 of one of the standard side sections 46.

Figure 4B:
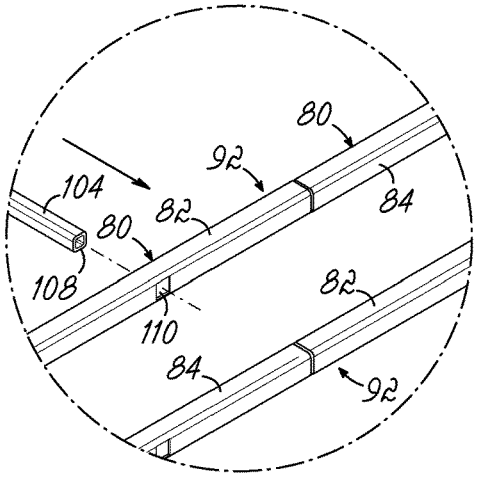
FIG. 4B is an enlarged perspective view of the encircled area 4A showing the middle sections joined together.
Figure 4C:
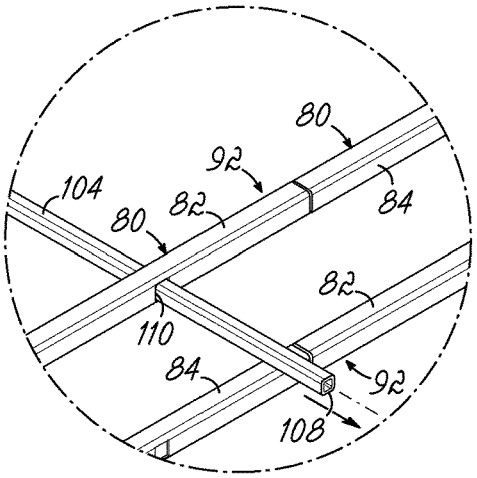
FIG. 4C is an enlarged perspective view of the encircled area 4B showing one of the decking members extending through one of the openings in one of the middle sections.

The swaged tube 82 and standard tube 84 of each middle section 80 have a plurality of openings 110 extending through them at spaced intervals which determine the locations of the decking members 104. As best shown in FIGS. 4A-4C, each of the decking members 104 extends through one of the openings 110 in whichever of the tubes 82, 84 of each middle section 80 is above the other tube. In other words, the decking members 104 extend through the openings 110 of the upper tubes 82, 84 (one each) of the middle ladder 78.

Figure 8A:
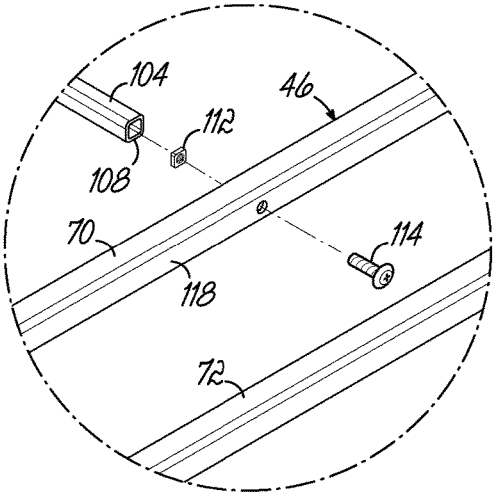
FIG. 8A is an enlarged perspective view of the encircled area 8A of FIG. 3.

As shown in FIGS. 3 and 8A, two of the eight decking members 104 shown in the drawings are secured to the outer frame 48 with fasteners, thereby adding stability and rigidity to the foundation 10. However, any number of decking members may be secured to the outer frame in any known manner.

Figure 4D:
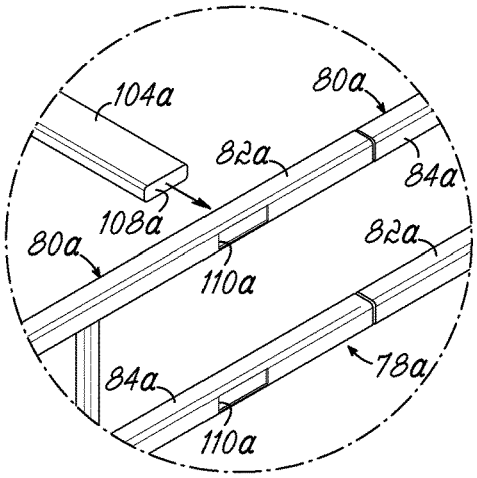
FIG. 4D is an enlarged perspective view of an area like FIG. 4B showing another embodiment of foundation.

FIG. 4D illustrates alternative decking members 104*a*, each having a solid, as opposed to hollow interior and opposed ends 108*a* (only one being shown). Each of the decking members 104*a* extends between one of the swaged side sections 44 and one of the standard side sections 46. More particularly, each of the decking members 104*a* extends between one of the upper tubes 56 of one of the swaged side sections 44 and one of the upper tubes 70 of one of the standard side sections 46.

In this embodiment, the swaged tube 82*a* and standard tube 84*a* of each middle section 80*a* have a plurality of openings 110*a* extending through them at spaced intervals which determine the locations of the decking members 104*a*. As best shown in FIG. 4D, each of the decking members 104*a* extends through one of the openings 110*a* in whichever of the tubes 82*a*, 84*a* of each middle section 80*a* is above the other tube. In other words, the decking members 104*a* extend through the openings 110*a* of the upper tubes 82*a*, 84*a* (one each) of the middle ladder 78*a*. One skilled in the art would appreciate that the openings in the foundation sides would have to receive the decking members 104*a* in the same manner as described herein. The decking members 104*a* may be made of wood or plastic or any known material.

As shown in FIGS. 3 and 8A, two of the eight decking members 104 shown in the drawings are secured to the outer frame 48 with fasteners, thereby adding stability and rigidity to the foundation 10. However, any number of decking members may be secured to the outer frame in any known manner.

Figure 8B:
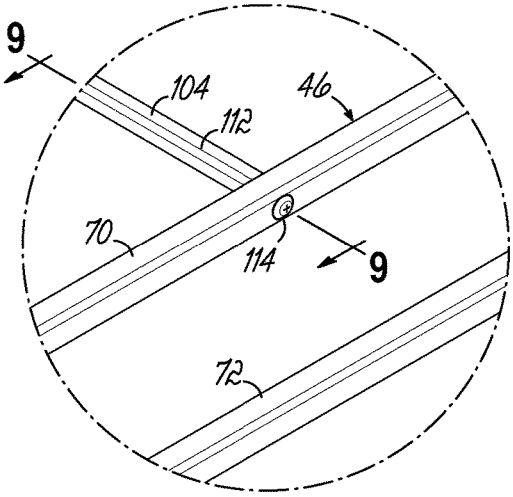
FIG. 8B is an enlarged perspective view of the encircled area 8A showing one end of one of the decking members secured to one of the side sections with a nut and bolt.
Figure 9:
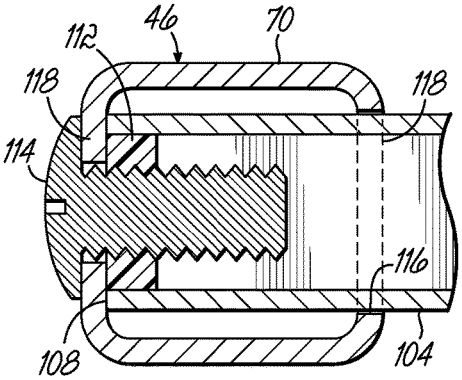
FIG. 9 is a cross-sectional view taken along the line 9-9 of FIG. 8B.

As best shown in FIG. 8A, each of the decking members 104 secured to the outer frame 48 has a nut 112 inserted inside the hollow interior 106 of the decking member 104 at each end (only one being shown). Each nut 112 (only one being shown in FIGS. 8A, 8B and 9) is adapted to receive a screw 114 (only one being shown in FIGS. 8A, 8B and 9). FIGS. 8A, 8B and 9 show one screw 114 extending through openings 116 in sidewalls 118 of the upper tube 70 of standard side section 46. At the other end of decking member 104 shown in FIGS. 8A, 8B and 9, another screw and nut secure the other end of decking tube 104 to the upper tube 56 of swaged side section 44 at the foot end of the foundation 10. See FIG. 3.

As shown in FIG. 3, at the head end of the foundation 10, another one of the decking members 104 is secured to the outer frame 48 using nuts 112 and screws 114 in a similar manner. The screws 114 and nuts 112 function to secure two of the decking members 104 to the outer frame 48 and, more particularly, secure each of two decking members 104 (one per end) to one of the swaged side sections 44 and one of the standard side sections 46, thereby adding stability and rigidity to the foundation 10.

Figure 10:
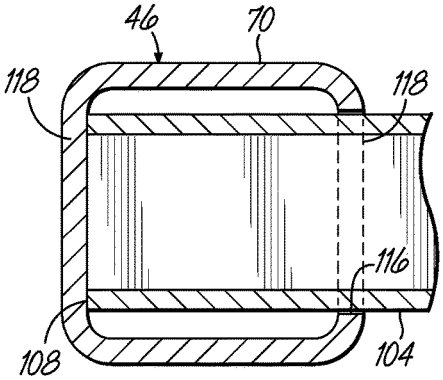
FIG. 10 is cross-sectional view of one end of one of the decking members being secured to one of the side sections without any fasteners.

As shown in FIG. 10, the other decking members 104 not equipped with nuts 112 have ends which extend through an opening 116 in an interior sidewall 118 of one of the upper tubes of one of the side sections and abut the other sidewall 118 of the tube.

Figure 16:
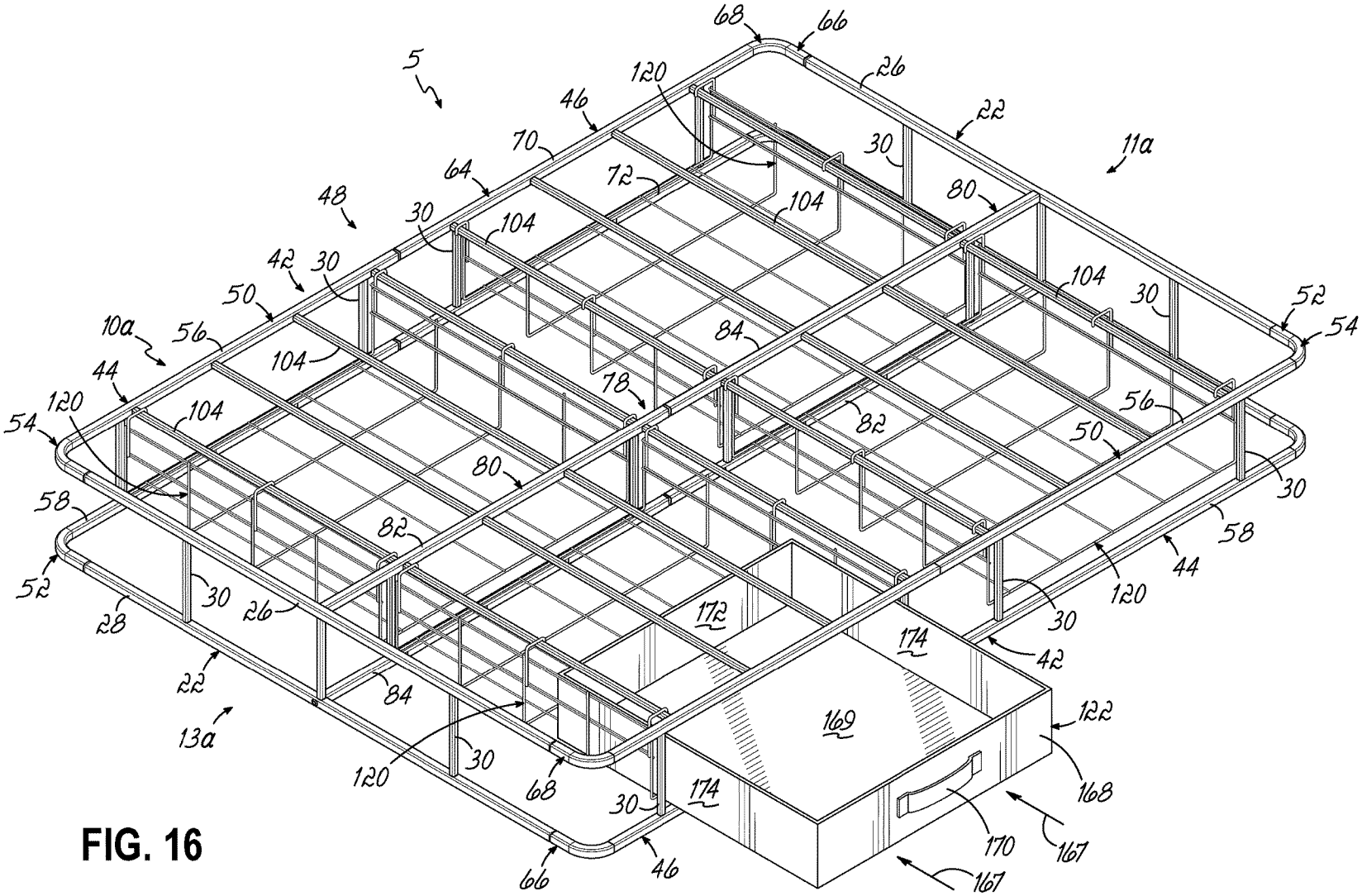
FIG. 16 is a perspective view of the foundation frame with four basket assemblies showing one drawer being inserted into each of the basket assemblies.
Figure 17:
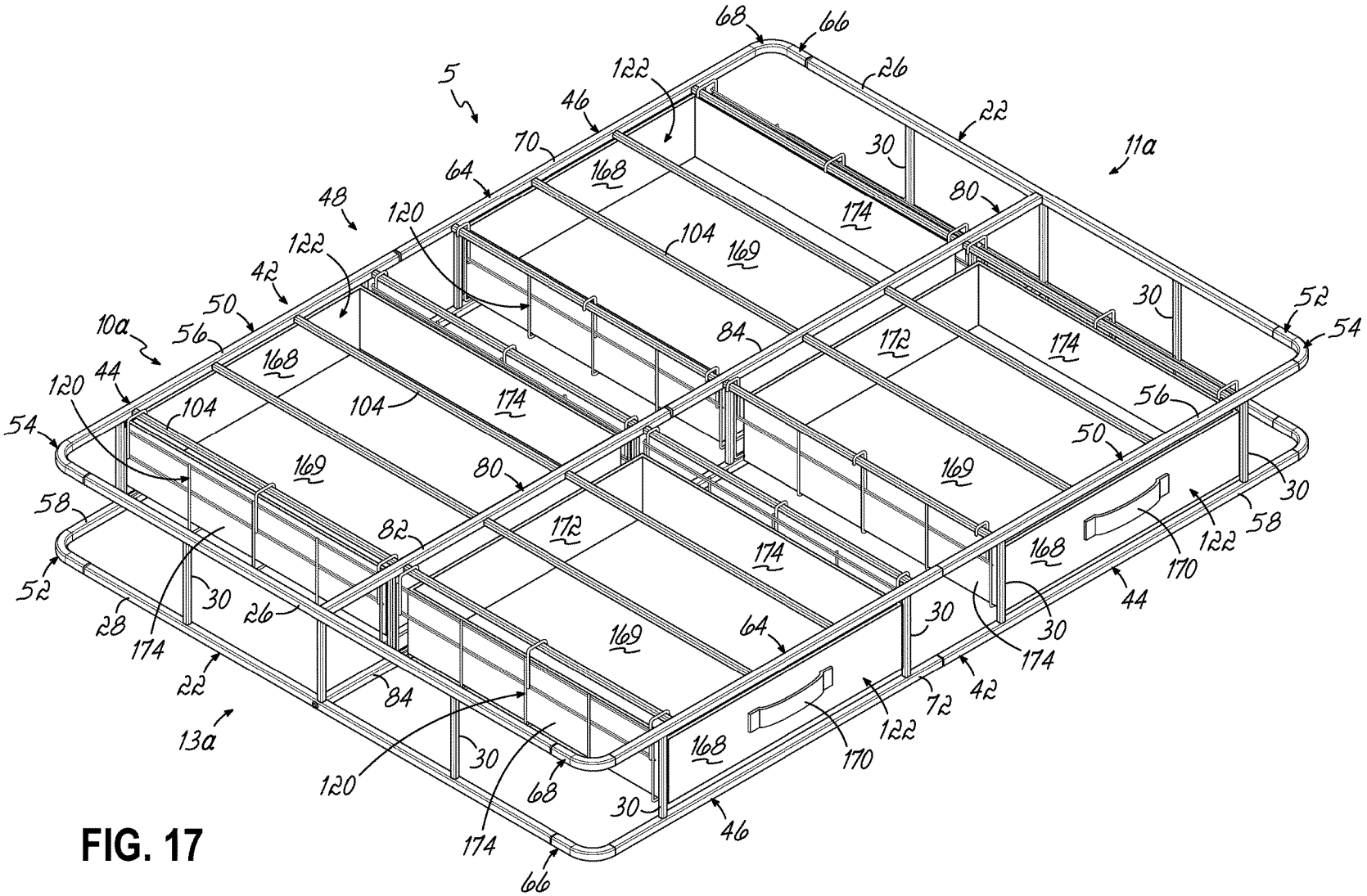
FIG. 17 is a perspective view of the foundation frame with four basket assemblies and four drawers being located in the four basket assemblies.
Figure 18:
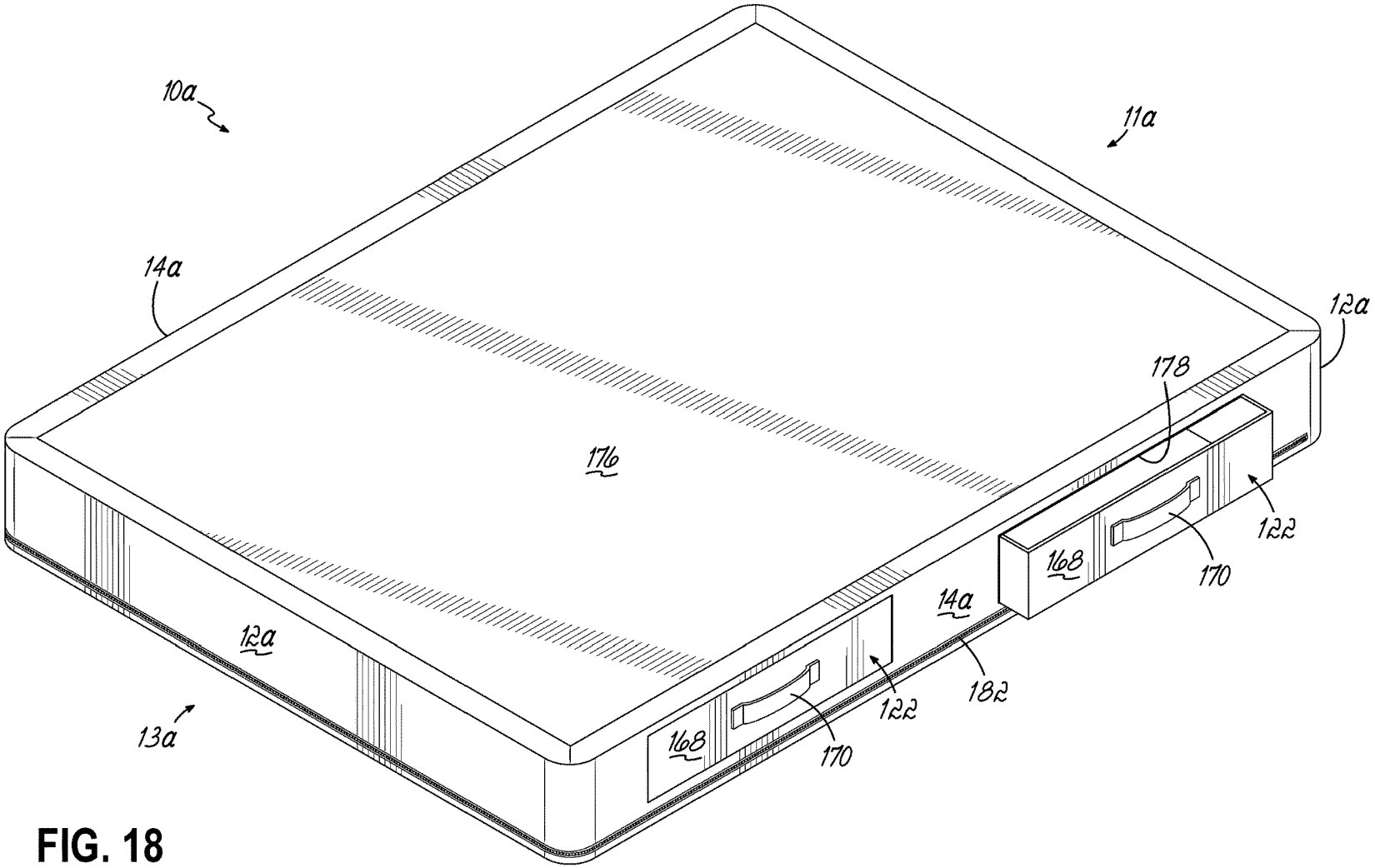
FIG. 18 is a perspective view of the embodiment of foundation shown in FIGS. 12-17.

FIGS. 12-18 illustrate another embodiment of mattress foundation 10*a* shown completed in FIG. 18. In an assembled condition, the mattress foundation 10*a* has a pair of end surfaces 12*a* defining a length or longitudinal dimension L of the foundation 10*a*. The foundation 10*a* has a pair of opposed side surfaces 14*a* defining a width W of the assembled foundation 10*a*. As best shown in FIG. 18, the assembled foundation 10*a* has a head end 11*a* and a foot end 13*a*.

As best shown in FIGS. 17 and 18, the assembled foundation 10*a* comprises the foundation frame 5 of the foundation 10 described above; four basket assemblies 120 secured to the foundation frame 5 and four pull-out drawers 122.

Figure 12:
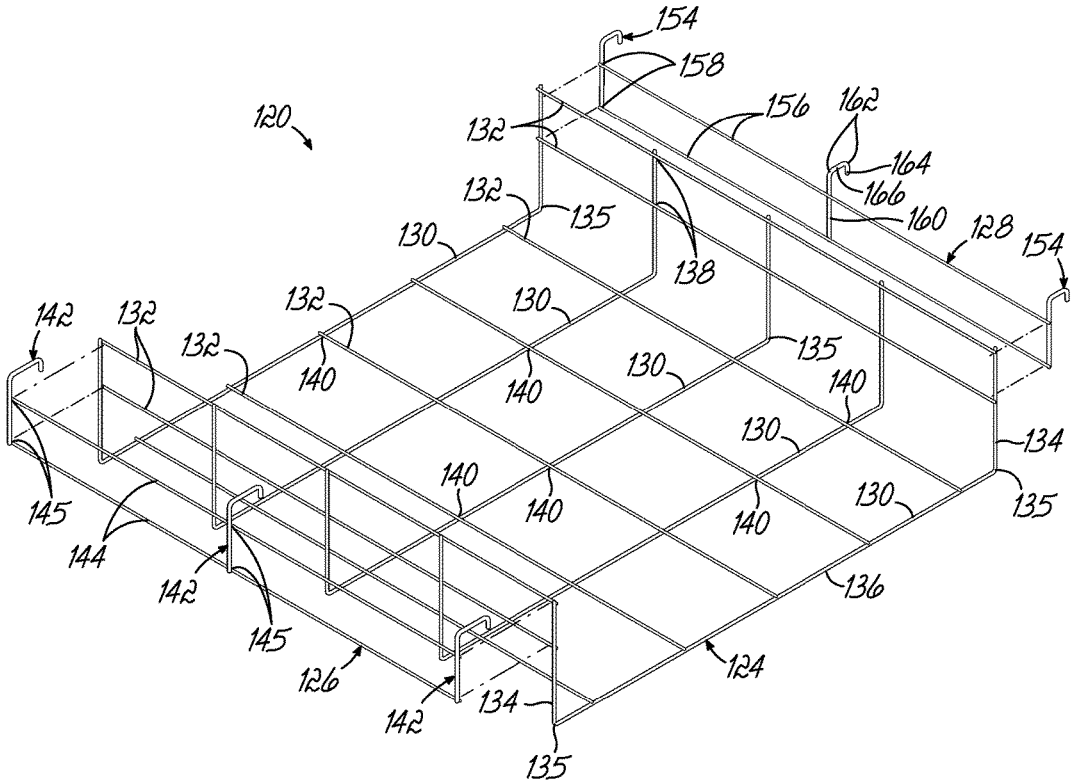
FIG. 12 is a partially disassembled view of a basket assembly for use in the foundation shown in FIG. 18.
Figure 13A:
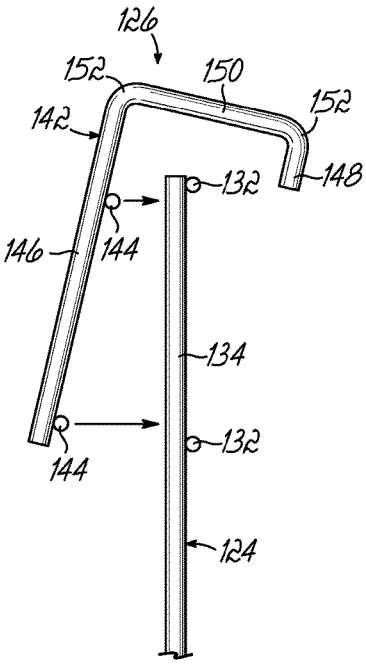
FIG. 13A is a side elevational view of a large hook assembly being secured into a basket sub-assembly.
Figure 13B:
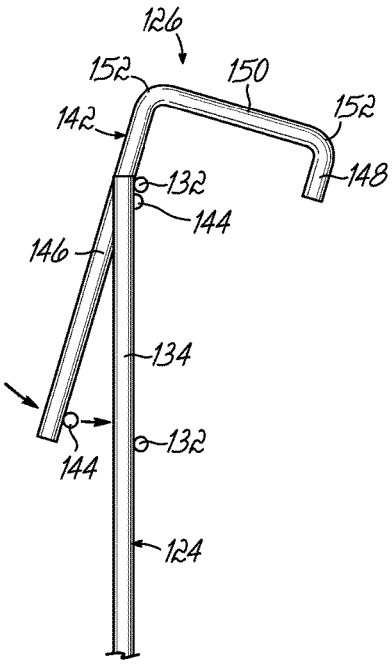
FIG. 13B is a side elevational view of the large hook assembly further being secured into the basket sub-assembly of FIG. 13A.
Figure 13C:
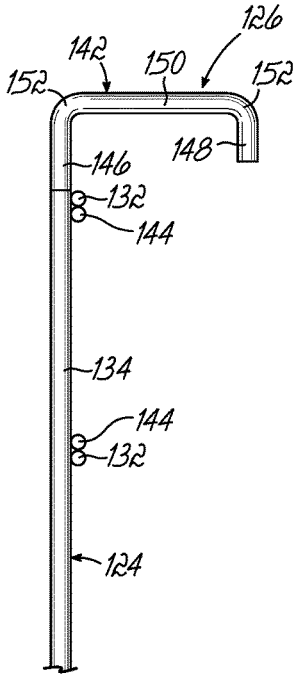
FIG. 13C is a side elevational view of the large hook assembly fully secured to the basket sub-assembly of FIG. 13A.

FIGS. 12-13C illustrate the construction of one of the basket assemblies 120. Each basket assembly 120 comes to a customer fully assembled; FIGS. 12-13C merely illustrate the components of each basket assembly 120. As shown in FIG. 12, each basket assembly 120 comprises three components: a U-shaped basket sub-assembly 124, a large hook assembly 126 and a small hook assembly 128.

The U-shaped basket sub-assembly 124 comprises a plurality of spaced U-shaped wires 130 welded to a plurality of spaced cross wires 132 at intersections 138, 140. Each of the U-shaped wires 130 is preferably made of five gauge wire, and each of the cross wires 132 is preferably made of nine gauge wire. Although the U-shaped basket sub-assembly 124 is illustrated comprising five U-shaped wires 130 and nine cross wires 132, the drawings are not intended to be limiting. The U-shaped basket sub-assembly 124 of wire basket assembly 120 may be any desired size. Each of the five U-shaped wires 130 is bent at two locations 135 so as to impact a U-shape to the wire 130. The bent wire 130 has two side portions 134 and a middle portion 136 between the side portions 134. Two cross wires 132 are welded to each of the side portions 134 of each of the U-shaped wires 130 at locations 138, and five additional cross wires 132 are welded to the middle portion 136 of each of the U-shaped wires 130 at locations 140.

The large hook assembly 126 comprises three hook-shaped wires 142 welded to two longitudinal wires 144 at intersections 145. As best shown in FIG. 13A, each of the hook-shaped wires 142 has a long leg 146, a short leg 148 and connector 150 joining the long and short legs. Each of the three hook-shaped wires 142 is bent at two locations 152 so as to impact a U-shape to the wire 142. Although the large hook assembly 126 of each basket assembly 120 is illustrated comprising three hook-shaped wires 142 and two longitudinal wires 144, the drawings are not intended to be limiting. The large hook assembly 126 of each wire basket assembly 120 may be any desired size.

As shown in FIG. 12, the small hook assembly 128 of each basket assembly 120 comprises three hook-shaped wires 154 welded to two longitudinal wires 156 at intersections 158. As best shown in FIG. 12, each of the hook-shaped wires 154 has a long leg 160, a short leg 164 and connector 166 joining the long and short legs. Each of the three hook-shaped wires 154 is bent at two locations 162 so as to impact a U-shape to the hook-shaped wire 154. Although the small hook assembly 128 of each basket assembly 120 is illustrated comprising three hook-shaped wires 154 and two longitudinal wires 156, the drawings are not intended to be limiting. The small hook assembly 128 of each wire basket assembly 120 may be any desired size.

Figure 14:
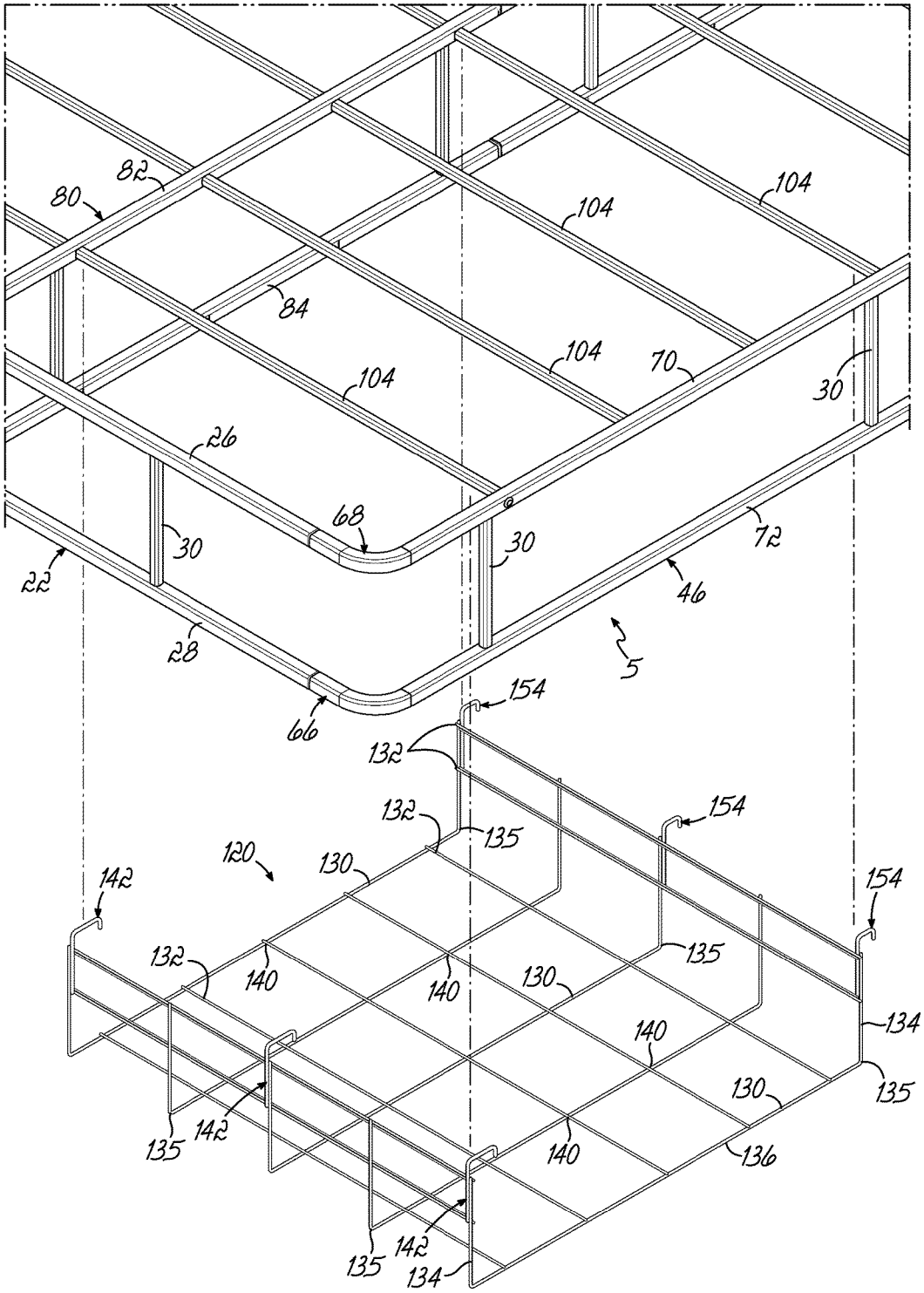
FIG. 14 is a partial perspective view of a basket assembly being inserted into the interior of the foundation frame.
Figure 15:
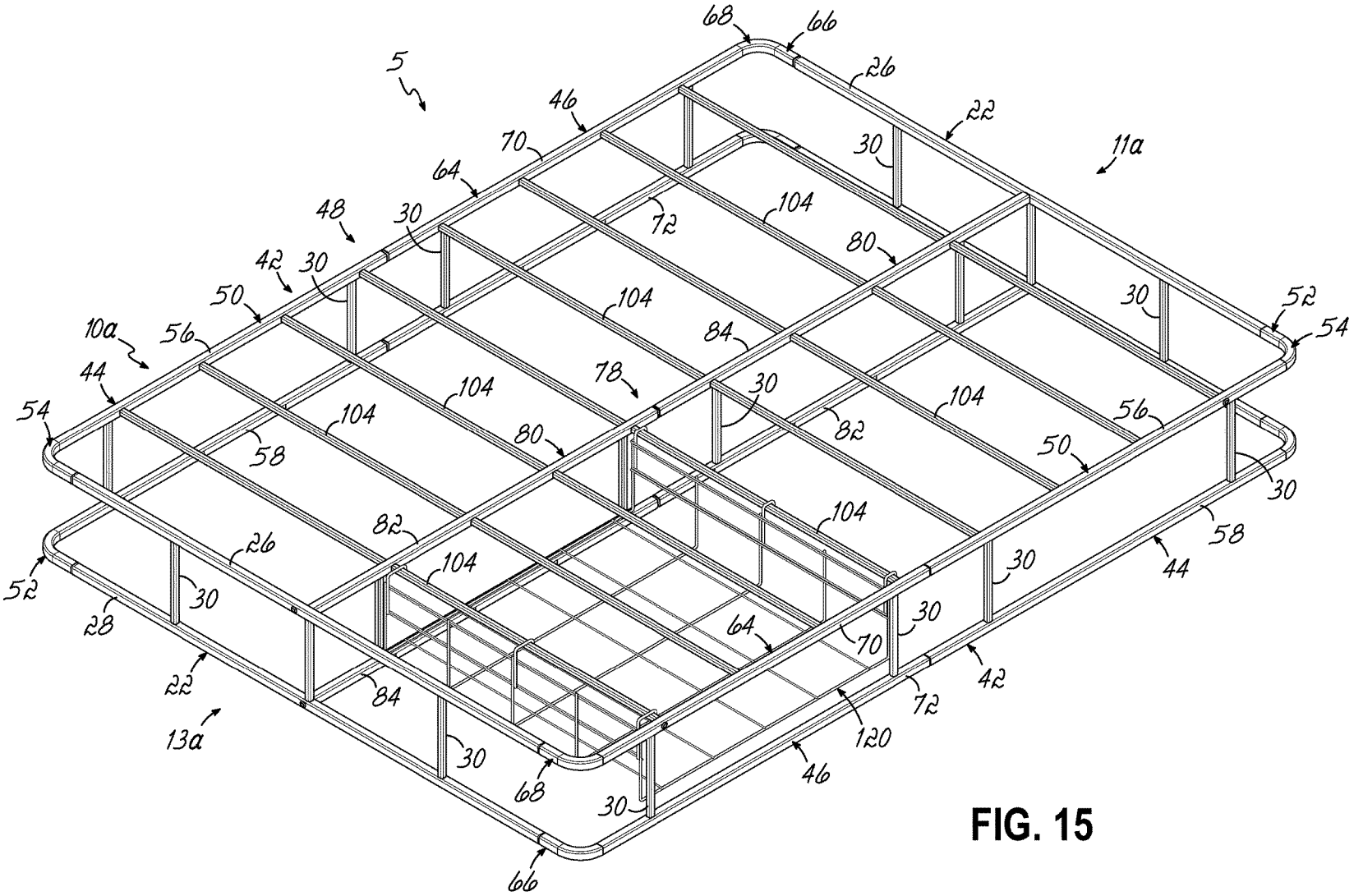
FIG. 15 is a perspective view of the foundation frame with one basket assembly.

FIG. 14 illustrates one of the fully assembled basket assemblies 120 being raised into the interior of the foundation frame 5 such that the three hook-shaped wires 154 of the basket assembly 120 engage or hang from one of the decking members 104 and the three hook-shaped wires 142 of the basket assembly 120 engage or hang from another one of the decking members 104 of the foundation frame 5. As shown by the dashed lines in FIG. 14, the three hook-shaped wires 154 of the basket assembly 120 hang from the fourth decking member 104 counting from left to right as shown in FIG. 14 or from the foot end towards the head end of the foundation 10*a*. Similarly, as shown by the dashed lines in FIG. 14, the three hook-shaped wires 142 of the basket assembly 120 hang from the first decking member 104 counting from left to right as shown in FIG. 14 or from the foot end towards the head end of the foundation 10*a*. FIG. 15 illustrates the basket assembly 120 of FIG. 14 hanging inside the interior of the foundation frame 5 as described above.

FIG. 16 illustrates four basket assemblies hung from the decking members 104 of the foundation frame 5 described above, two on each side of the middle ladder 78. FIG. 16 further illustrates one of the four drawers 122 of foundation 10*a* being inserted in the direction of arrows 167 into one of the four basket assemblies 120 supported by the foundation frame 5. As shown in FIG. 16, each drawer 122 has a bottom 169, a front wall 168 to which is attached a handle 170, a rear wall 172 and two opposed side walls 174. The drawer 122 is inserted and removed from the basket assembly 120 by an operator using handle 170. Although one configuration of handle 170 is illustrated, the handle 170 may be any configuration and is not intended to be limited by the drawings.

FIG. 17 illustrates all four drawers 122 residing inside the basket assemblies 120. FIG. 18 illustrates the foundation 10*a* of FIG. 17 with the foundation frame 5 being covered with a covering 176. The covering 176 has four openings 178 which allow an operator to open and close each of the four drawers 122 using handles 170. The cover 176 further has a zipper 182 to access the interior of the foundation 10.

A customer may order the accessory kit of four basket assemblies 120, four drawers 122 and cover 176. As shown in FIG. 19, the cover 176 would replace cover 18 of FIG. 1 in box 200 which contains the contents of the foundation frame 5. The cover 176 having the four openings 178 takes the place of the cover 18 shown in FIG. 1. Although the zipper 182 is shown at a certain location in FIG. 18, the zipper 182 may be at any desired location.

FIG. 19 illustrates all the components of the foundation 10 including the components of foundation frame 5 and cover 18 before being shipped inside a box 200. FIG. 20 illustrates the components shown in FIG. 19 inside box 200.

Figure 3A:
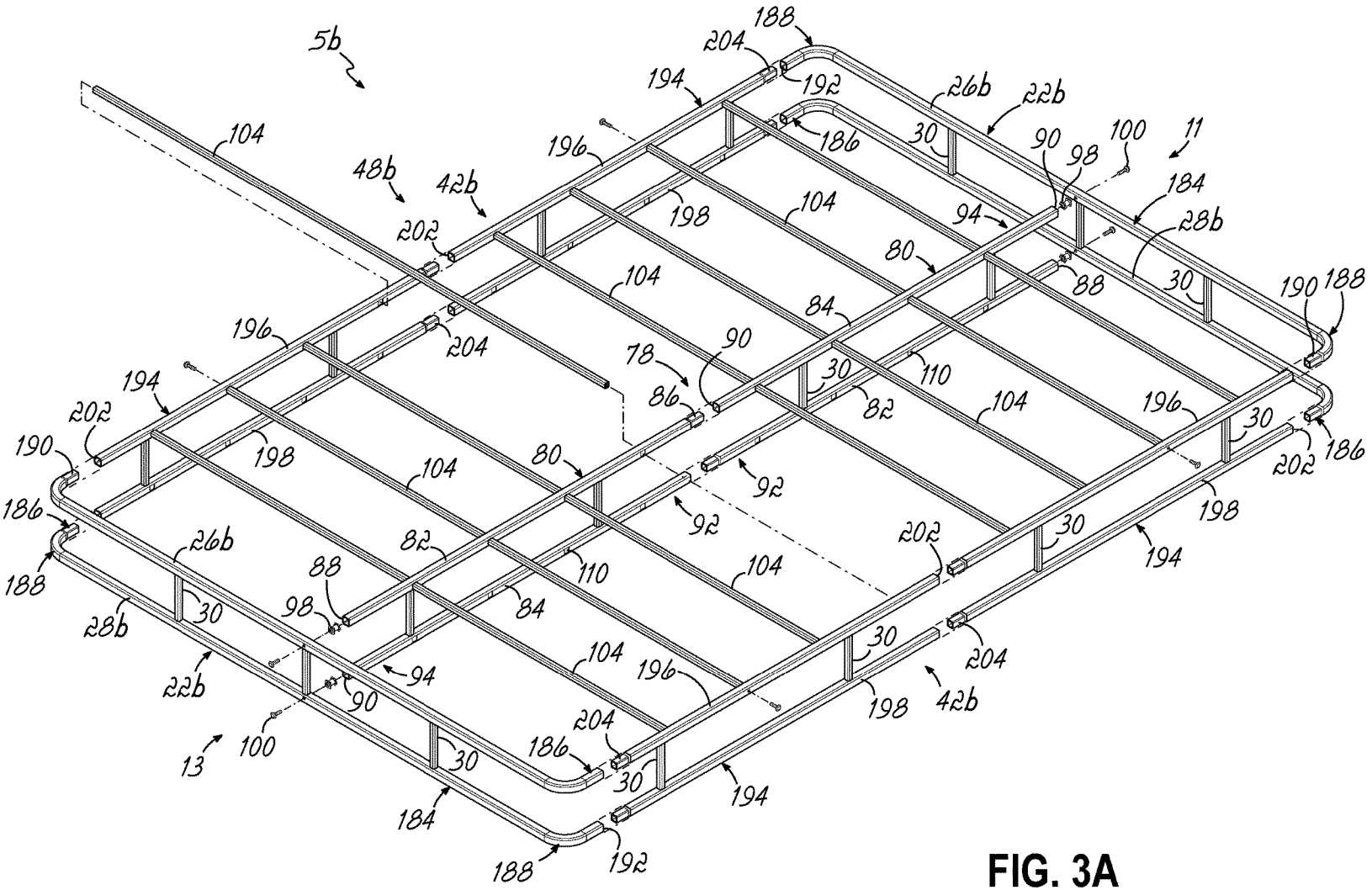
FIG. 3A is a perspective view of another embodiment of modular bedding foundation in a partially disassembled condition.

FIG. 3A illustrates the modules and decking members of another embodiment of foundation frame 5*b* prior to assembly. The modular foundation frame 5*b* comprises two identical end sections 22*b* which differ from the end sections 22 of foundation frame 5 described above. One of the end sections 22*b* is located at the head end 11 of the foundation 10 and is referred to as a head end section. The other end section 22*b* is located at the foot end 13 of the foundation 10 and is referred to as a foot end section 22*b*.

As best shown in FIG. 3A, each of the end sections 22*b* has a main portion 184, two leg portions 186 and two rounded corner portions 188. Each rounded corner portion 188 joins the main portion 184 to one of the leg portions 186. Therefore, each of the end sections 22*b* is generally U-shaped. Each end section 22*b* comprises a generally U-shaped upper tube 26*b*, a generally U-shaped lower tube 28*b* and a plurality of spacers 30 extending between the upper and lower tubes 26*b*, 28*b*. Each of the spacers 30 is preferably welded, but may be secured in any known manner, to the upper and lower tubes 26*b*, 28*b* of each end section 22*b*. Although each end section 22*b* is illustrated having three spacers 30, any number of spacers may be used.

Each of the generally U-shaped upper and lower tubes 26*b*, 28*b* of each of the end sections 22*b* has one swaged end 190 and one hollow end 192.

The assembled modular bedding foundation frame 5*b* further comprises two sides 42*b*. As best shown in FIG. 3A, each side 42*b* comprises two identical side sections 194 joined together. Together, the four side sections 194 and two end sections 22*d* make up an outer frame 48*b*. The six sections of the outer frame 48*b* are joined together without the use of fasteners, the swaged ends of some of the outer frame sections fitting inside hollow ends of other of the outer frame sections.

As best shown in FIG. 3A, each of the four side sections 194 of the outer frame 48*b* is generally planar and ladder-shaped. Each side section 194 comprises a straight upper tube 196, a straight lower tube 198 and a plurality of spacers 30 extending between the upper and lower tubes 196, 198. Although each side section 194 is illustrated having two spacers 30, any number of spacers may be used. As best shown in FIG. 3A, at one end of the of each side section 194, each of the upper and lower tubes 196, 198, respectively, has a hollow end 202 at the outer end of the tube. At the other end of each side section 194, each of the upper and lower tubes 196, 198, respectively, has a swaged end 204 at the outer end of the tube.

The middle ladder 78 and decking members 104 of foundation frame 5*b* are illustrated being identical to those of foundation frame 5. However, the decking members 104*a* of FIG. 4D may be used in foundation frame 5*b* or any foundation frame shown or described herein.

Although the drawings show specific configurations of foundation frames, one skilled in the art will appreciate that any swaged end and hollow end may be reversed in any of the connections or joints of any of the foundation frames shown or described herein.

The embodiments of the invention shown and described are for illustrative purposes only. The drawings and the description shall not limit in any way the scope of the invention as defined in the claims. While those skilled in the art may make various changes to, or additional embodiments of, the invention, none of those changes/embodiments shall be deemed to depart from the spirit of the invention. Thus, all such changes/embodiments shall be embraced by the scope of the invention as defined in the claims. Accordingly, the invention is to be limited only by the scope of the following claims and their equivalents.

The invention claimed is:

1. A modular mattress foundation comprising: two sides, each side comprising a swaged side section and a standard side section, each of the standard side sections comprising upper and lower generally L-shaped tubes each having open ends and a plurality of spacers extending between the generally L-shaped upper and lower tubes; each of the swaged side sections comprising generally L-shaped upper and lower tubes and a plurality of spacers extending between the generally L-shaped upper and lower tubes of the swaged side section, one end of each of the generally L-shaped upper and lower tubes of the swaged side section being swaged and being retained inside one of the open ends of one of the generally L-shaped tubes of one of the standard side sections; a head end section; a foot end section, each of the end sections comprising a straight upper tube, a straight lower tube and a plurality of spacers, each end of each of the straight upper and lower tubes being swaged, the swaged ends of each of the straight upper and lower tubes fitting inside the open ends of the generally L-shaped tubes of one of the side sections; a middle ladder comprising two middle sections joined together, each of the middle sections comprising a straight upper tube, a straight lower tube and a plurality of spacers, at least one of the straight upper and lower tubes of each middle section having openings extending through the tube; decking members extending through the openings in the middle sections, each of the decking members having end portions located inside the upper generally L-shaped tubes of the side sections.

2. The foundation of claim 1 wherein the middle sections are secured to the head and foot end sections.

3. The foundation of claim 1 wherein the decking members are tubes.

4. The foundation of claim 1 wherein at least some of the decking members are secured to the sides with fasteners.

5. The foundation of claim 4 wherein the fasteners comprise nuts and bolts, the nuts being located inside the end portions of the decking members.

6. The foundation of claim 1 further comprising a covering.

7. The foundation of claim 1 wherein only one of the straight upper and lower tubes of each of the middle sections has a swaged end, the swaged end of one of the middle sections fitting inside a hollow end of the other middle section of the middle ladder.

8. The foundation of claim 1 wherein each middle section has an inner side and an outer side, nuts being located inside the straight upper and lower tubes at the outer sides and one of the straight upper and lower tubes having a swaged end at the inner side.

9. A modular mattress foundation comprising:

four generally L-shaped side sections, each of the generally L-shaped side sections having a long portion and a short portion joined by a corner portion;

two end sections, each of the end sections comprising a straight upper tube, a straight lower tube and a plurality of spacers extending between the straight upper and lower tubes of the end section, each end of each of the straight upper and lower tubes being swaged, the swaged ends of each of the straight upper and lower tubes of the end sections being retained inside open ends of tubes of the short portions of the generally L-shaped side sections to join the end and generally L-shaped side sections without fasteners;

a middle ladder comprising two middle sections joined together without fasteners, each of the middle sections comprising a straight upper tube, a straight lower tube and a plurality of spacers; and decking members extending through openings of the middle sections, each of the decking members having end portions located inside the generally L-shaped side sections.

10. The foundation of claim 9 wherein one end of each of the straight upper and lower tubes of each middle section is swaged.

11. The foundation of claim 9 each of the middle sections is identical.

12. The foundation of claim 9 wherein at least some of the decking members are secured to the side sections.

13. The foundation of claim 9 wherein two of the four generally L-shaped side sections are identical and located on opposite corners of the foundation.

14. The foundation of claim 9 wherein at least some of the decking members are tubes.

15. The foundation of claim 9 wherein at least some of the decking members are wooden slats.

16. A modular mattress foundation comprising: an outer frame comprising four side sections, a generally planar head end section and a generally planar foot end section, each of the sections of the outer frame being joined together without fasteners; each of the side sections comprising upper and lower generally L-shaped tubes and spacers extending between the generally L-shaped upper and lower tubes, each of the generally L-shaped upper and lower tubes of the side section having a long leg portion, a short leg portion and a rounded corner, each of the short leg portions terminating in a hollow end, swaged ends of the head and foot end sections being retained inside hollow ends of the side sections: a middle ladder secured to the head and foot end sections of the outer frame, the middle ladder comprising multiple middle sections joined together without fasteners, each of the middle sections comprising straight upper and lower tubes and a plurality of spacers; decking members extending through openings in the middle sections, each of the decking members having end portions located inside the upper generally L-shaped tubes of the side sections.

17. The foundation of claim 16 wherein each of the end sections comprises a straight upper tube, a straight lower tube and a plurality of spacers extending between the straight upper and lower tubes of the end section, each end of each of the straight upper and lower tubes being swaged.

18. The foundation of claim 16 wherein each of the middle sections is identical.

19. The foundation of claim 16 wherein the foundation comprises two middle sections.

20. The foundation of claim 16 wherein the middle sections are secured to the end sections.

21. The foundation of claim 16 wherein at least some of the decking members are tubes.

22. The foundation of claim 16 wherein at least some of the decking members are wooden slats.

* * * * *